United States Patent [19]

Putnam, Jr. et al.

[11] 4,043,098

[45] Aug. 23, 1977

[54] VERTICAL FORM, FILL AND SEAL PACKAGING MACHINE WITH IMPROVED BACK-UP BAR FOR LONGITUDINAL SEALING

[75] Inventors: Roger L. Putnam, Jr., East Longmeadow; Edward F. O'Brien, Northampton, both of Mass.

[73] Assignee: Package Machinery Company, East Longmeadow, Mass.

[21] Appl. No.: 718,072

[22] Filed: Aug. 26, 1976

[51] Int. Cl.[2] ..... B65B 9/12

[52] U.S. Cl. ..... 53/180 M; 93/82; 156/466

[58] Field of Search ..... 53/180 M, 182 M; 93/82; 156/466

[56] References Cited

U.S. PATENT DOCUMENTS

| | | | |
|---|---|---|---|
| 2,899,875 | 8/1959 | Leasure | 93/82 |
| 3,267,822 | 8/1966 | Harrison | 93/82 |
| 3,935,048 | 1/1976 | Rucker | 53/180 M |

*Primary Examiner*—Robert Louis Spruill
*Attorney, Agent, or Firm*—McCormick, Paulding & Huber

[57] ABSTRACT

A package making machine of the vertical form, fill and seal type has a tube former for receiving packaging material in thin flat strip form and for juxtaposing opposite side edges thereof in parallel vertically extending and overlapped relationship to provide a depending tube open at the top. A product dispenser discharges measured quantities of product to the tube interior space, a lower end portion thereof being sealed transversely by an end sealing apparatus. Tube advancing means may comprise intermittently operable vertically extending vacuum belts or, alternatively, the end sealer may be reciprocated vertically to draw the strip material downwardly through the former. At a longitudinal seam sealing station beneath the former a vertically elongated sealing bar moves to engage and to seal the overlapped longitudinal edges of the tube. A sealing back-up bar within the tube is pivotally supported at its mid-point by a depending support member and freely adjusts angularly to provide precise parallelism and uniform pressure distribution between and throughout the length of the sealing and back-up bars. Narrow elongated tube spreaders depend within the tube to maintain the tube open in cooperation with the back-up bar and its support member, a relatively unobstructed product fall space thus being provided.

11 Claims, 11 Drawing Figures

FIG. 1
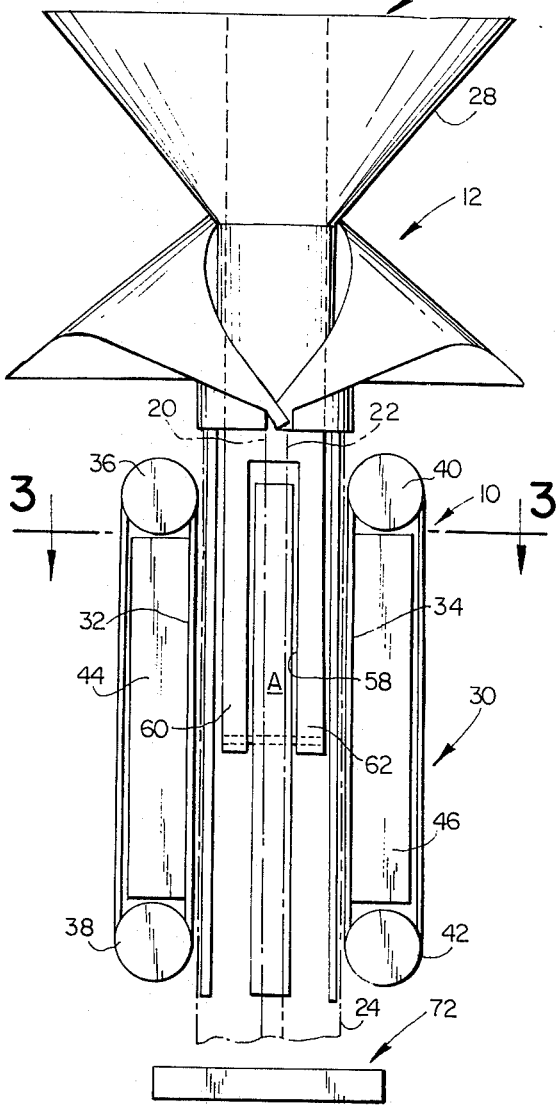
FIG. 2
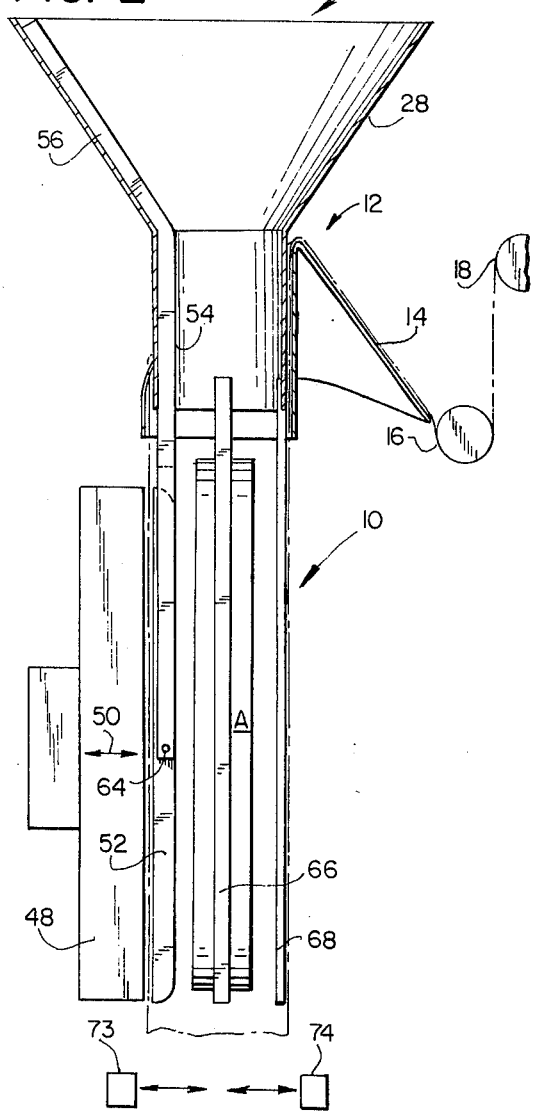
FIG. 3
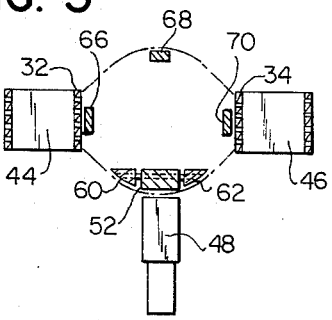
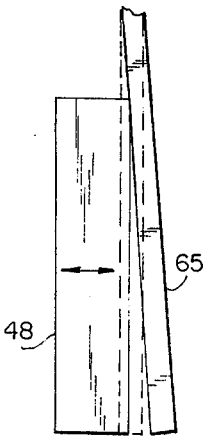
FIG. 4 PRIOR ART
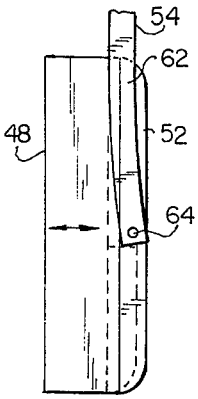
FIG. 5

VERTICAL FORM, FILL AND SEAL PACKAGING MACHINE WITH IMPROVED BACK-UP BAR FOR LONGITUDINAL SEALING

BACKGROUND OF THE INVENTION

This invention relates to machines for forming, filling and sealing packages from a thin flat strip of packaging material, the strip of packaging material being formed to a tubular configuration, sealed longitudinally at overlapped edge portions, intermittently sealed transversely along lines spaced longitudinally of the tube, and filled with measured quantities of product between successive transverse sealing operations. More particularly, the invention relates to machines in this general category sometimes characterized as being of the "tubeless" type. In a tubeless form, fill and seal packaging machine the formation of the tube of packaging material does not occur on or about a supporting tube but instead the space within the formed tube is maintained as free as possible of obstruction, a narrow elongated sealing back-up bar and one or more narrow elongated tube spreaders being the only impediments to free product fall within the formed tube. Such machines have been generally satisfactory in the past but difficulties have been encountered in the longitudinal edge sealing operation. With a tubeless machine the narrow elongated sealing back-up bar may tend to flex or otherwise undergo slight movement when subjected to the considerable force exerted by its complementary sealing bar. Resulting loss of parallelism and non-uniform pressure distribution between and throughout the length of the two bars may of course have serious detrimental effects in the sealing operation and partially open or otherwise inferior longitudinal edge seals may result. Alternatively, strengthening and increasing the mass of the back-up bar creates further obstruction to free product fall and tends to defeat the very purpose of the tubeless machine.

SUMMARY OF THE INVENTION

It is the general object of the present invention to provide a packaging machine of the tubeless form, fill and seal type wherein an improved longitudinal sealing back-up bar is provided, wherein precise parallelism is maintained between the bar and its associated sealing bar for uniform pressure distribution and enhanced sealing efficiency throughout the length of the bars, and wherein minimal obstruction to free product fall is yet achieved.

In fulfillment of this object a free swinging arrangement is provided with the back-up bar pivotally mounted approximately at its mid-point on a depending support member. The bar is thus adapted for automatic and precise adjustment to any misalignment or off-line movement of the sealing bar and accurate registry and precise parallelism of the bars results in all circumstances. Both the back-up bar and its support member are of minimal cross sectional mass for unobstructed and free product fall within the tube of packaging material.

BRIEF DESCRIPTION OF THE DRAWINGS

FIG. 1 is a somewhat schematic front elevational view of a portion of a form, fill and seal packaging machine showing a round tube former, a first tube advancing means, and end sealer, a product dispenser and a first embodiment of the improved back-up bar arrangement of the present invention.

FIG. 2 is a somewhat schematic side elevational view of the apparatus of FIG. 1 and also illustrates a longitudinal seam sealing bar and part of a supply source and guide roll system for the packaging material.

FIG. 3 is a horizontal cross sectional view taken generally as indicated at 3—3 in FIG. 1.

FIG. 4 is a somewhat schematic and fragmentary view of a prior art longitudinal seam sealing bar and its back-up bar.

FIG. 5 is a somewhat schematic and fragmentary view illustrating a longitudinal seam sealing bar and the improved back-up bar arrangement of the present invention.

DESCRIPTION OF THE PREFERRED EMBODIMENTS

Figure 7:
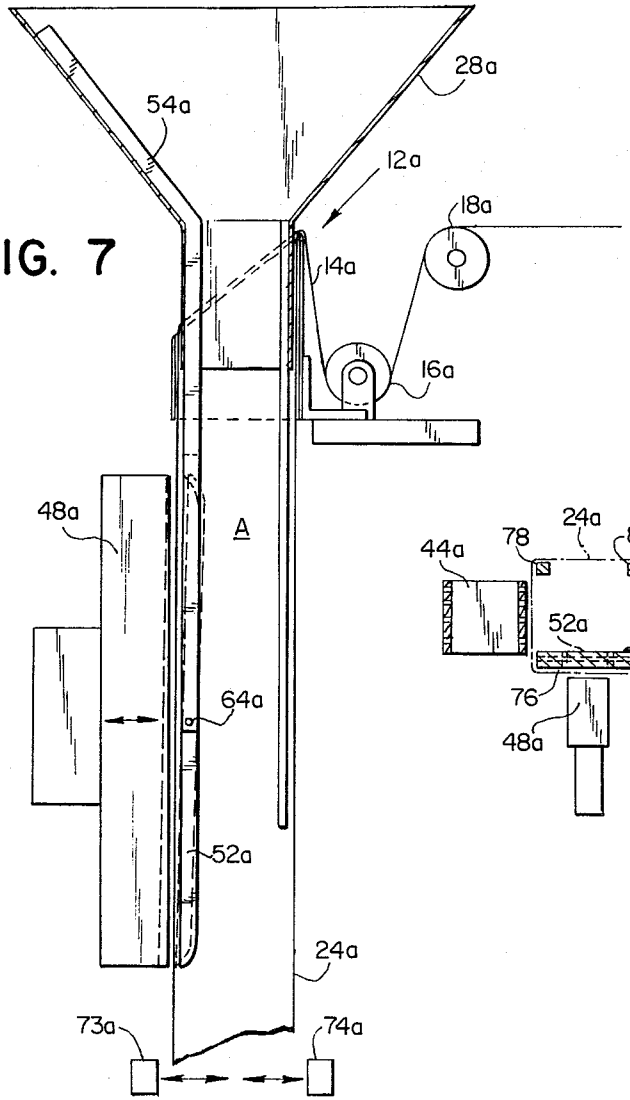
FIG. 7 is a somewhat schematic side elevational view of the apparatus of FIG. 6 and includes a longitudinal seam sealing bar and a partial illustration of a guide and supply system for the packaging material.

Referring particularly to FIGS. 1 through 3, it will be observed that a form, fill and seal packaging machine partially illustrated and indicated generally by the reference numeral 10 includes a conventional tube former 12. The tube former 12 is supplied with packaging material in the form of an elongated thin flat strip comprising successive package blanks as integral contiguous sections thereof. A strip of such material is indicated at 14, best illustrated in FIG. 2, and is directed in movement to the former by guide rolls 16, 18 from a source of supply which may take the form of a pay-off device havin a storage roll from which the strip material is drawn. In its passage through the former 12, the strip of material is continuously formed t: a depending and upwardly open tubular configuration, the opposite longitudinal edge portions thereof 20, 22 being progressively juxtaposed by the former in overlapping and in parallel vertically extending relationship. Thus, the strip of material 14 becomes a tube as at 24 in passage through the former and its edge portions 20, 22 are positioned for sealing but remain intitially in an unsealed condition as the tube progresses downwardly from the former.

The tube former 12 is of the "round" type and the tube 24 formed thereby has a generally cylindrical configuration in cross section, FIG. 3. In this regard, however, it is to be noted that the term "tube" is used in its broad sense and is not to be construed as limited to a cylindrical tube or to a tube of any particular cross sectional configuration. Similarly, terminology denoting geometrical or spacial relationship such as "vertical", "horizontal", "depending", "beneath", "subadjacent", etc. is employed for ease and convenience in description only and is not to be regarded as limiting in any sense in the description or in the claims which follow.

Product dispensing means associated with the tube former 12 is indicated generally by the reference numeral 26 and may comprise a funnel-like element 28 and a cooperative gate means (not shown) operable intermittently for the gravity discharge of measured quantities of product to the tube interior space through its upwardly open end. As will be explained more fully hereinbelow, tubes or tubular package blanks such as 24 are provided with end seals along longitudinally spaced transverse lines and a longitudinal or side seal is also provided at the edge portions 20, 22 whereby to form an upwardly open tubular package blank for reception of a measured quantity or charge of product from the dispenser 26.

Means for intermittently advancing or drawing the tube downwardly through the tube former 12 may vary in form within the scope of the invention. Tube advancing means illustrating schematically in FIGS. 1–3 and indicated generally by the reference numeral 30 take the form of a pair of horizontally spaced vertically extending belts 32, 34 respectively externally engageable with opposite sides of a tube or tubular package blank such as 24. The belts 32, 34 are at least partially perforate and have associated upper and lower pulleys 36, 38 and 40, 42 oppositely intermittently rotatable by conventional means not shown. Vacuum means 44, 46 associated with the belts 32, 34 and which may be conventional provide for suction gripping of the tube by the belts. Further, the vacuum means 44, 46 may be adapted to provide a positive pressure for a period of short duration near or at the end of each tube advancing movement, positive "blow-off" or release of the tube thus being insured.

As will be apparent, the tube advancing means 10 can be operated intermittently successively to present integral package blanks in tubular form to a longitudinal seam sealing station A disposed beneath the tube former 12. At the seam sealing station, an elongated seam sealing bar 48 extends vertically and externally adjacent a tubular blank for sealing the overlapped edge portions 20, 22 of the blank. The seam sealing bar is movable intermittently in a generally horizontal direction as indicated by arrow 50 toward and away from and into and out of sealing engagement with the edge portions 20, 22. Heat sealing and pressure sensitive sealing as well as other forms of sealing may be employed within the scope of the invention. Means for effecting the necessary movement of the bar may be conventional and of course operable in timed relationship with the tube advancing means 10.

Considerable sealing force is exerted by the bar 48 and a back-up bar or platen is disposed within the tube or tubular blanks such as 24. A back-up bar 52 forming a part of the improved back-up bar arrangement of the present invention takes the form of a narrow elongated member arranged to extend vertically within the tubular blank adjacent the overlapped edge portions 20, 22 and in approximate horizontal registry with the sealing bar 48. The back-up bar 52 is pivotally mounted approximately at its mid-point by a mounting means disposed at a lower end portion of an elongated support member 54 for the bar. The support member 54 extends vertically downwardly through the open upper end of the tube 24 and within the tube at the sealing station. As shown, an inclined upper end portion 56 of the support member 54 follows the contour of the funnel 28 and may be rigidly attached thereto and to the machine frame.

While the configuration of the support member 54 may vary within the scope of the invention, it is the presently preferred practice to provide a member with a bifurcated lower end portion which defines a vertically elongated open space 58 and arms 60, 62 on opposite sides thereof. The space 58 is exposed to the overlapped edge portions 20, 22 of the tube and an upper portion of the back-up bar 52 resides therein and projects slightly forwardly thereof as best illustrated in FIG. 2.

The mounting means for the back-up bar 52 preferably is positioned at a lower end portion of the support member 54 and takes the form of a horizontal pivot pin 64. The pin 64 has opposite end portions held by the arms 60, 62 in suitable openings therein and an intermediate portion of the pin is entered in a suitable opening approximately at the mid-point of the back-up bar. Obviously, the pin may be fixed in the arms and rotatably received in the back-up bar, or alternatively, the ends of the pin may be rotatable within the arm openings and the intermediate portion fixed in the bar.

With the back-up bar arrangement of the present invention, free angular bar adjustment is readily accommodated and precise parallelism is achieved between the back-up bar and its associated sealing bar 48. In consequence, uniform pressure distribution between and throughout the length of the sealing and back-up bars is provided and excellent sealing results are obtained. FIGS. 4 and 5 illustrate in contrast the prior art and the improved back-up bar operation. In FIG. 4 a sealing bar 48 is illustrated in sealing position. A back-up bar 65, originally in a precise vertical attitude as illustrated in broken line, has been moved to the exaggerated position shown in full line. That is, if rigidly attached, the bar has undergone a degree of flexing resulting in a heavy pressure distribution at an upper end portion thereof and a relatively light pressure distribution at its lower end portion. Similarly, it the bar 65 is pivoted at an upper end portion flexing thereof may be thus avoided but the bar is nevertheless swung through a slight angle resulting in a unsatisfactory pressure distribution condition as in the case of a rigid bar. In clear contrast and in the improved back-up arrangement of the present invention of FIG. 5, a sealing bar 52 assumes the precisely vertical attitude shown in broken line in its free condition. On engagement of the sealing bar 48 with the overlapped edge portions of a tube and on the exertion of considerable force thereby, a slight flexure may occur in the arms 60, 62 of the support member 54 but the bar 52 nevertheless adjusts automatically so as to remain in precise parallelism with the sealing bar. Irrespective of the amount of degree of force exerted by the sealing bar, the desired condition is maintained and sealing efficiency is greatly enhanced.

Reverting now to FIG. 3, it will be observed that the back-up bar support member 54 and particularly the arms 60, 62 thereof are provided with arcuate front faces exposed to the tube and substantially conforming thereto. The possibility of undesirable creasing or rupture of the tube in passing along sharp edges is thus avoided.

It will also be observed in FIG. 3 that the tube takes on a somewhat hexagonal configuration in cross section when engaged by the belts 32, 34. At least one tube spreader is provided in accordance with the invention and takes the form of a narrow elongated member fixedly supported at an upper end portion and depending through the open upper end of the tube at the sealing station. As shown, three such spreaders are provided at 66, 68 and 70 and are arranged to extend vertically within and in engagement with the tube approximately in equal circumaxially spaced relationship with respect to each other and with respect to the back-up bar 52 and its support member 54. The two side spreaders 66, 70 may be offset slightly outwardly as illustrated in the region of the tube engagement with the belts 32, 34 to aid in proper engagement for the suction gripping operation of the belts.

End sealing apparatus indicated generally at 72 may be conventional and is shown disposed beneath the longitudinal sealing station A. Such apparatus is operable intermittently to seal transversely end portions of the tubular blanks whereby initially to form partial packages with the bottoms sealed and with the tops open for product reception and thereafter to close the tops and form filled or product bearing packages. That is, the end sealing apparatus operates to provide a transverse or end seal at the lower end portion of an upwardly open tube, a measured quantity or charge of product is dispensed to the tube interior, the vacuum belts 32, 34 then operate to advance an integral and next succeeding tubular blank to the sealing station whereupon the operation is repeated. Thus, package formation comprises side and bottom end sealing, filling and advance for end sealing at the top of the package. Conventionally, end sealers operate to provide a transverse or end seal at the top of one package and to provide simultaneously a bottom end seal on the next succeeding package or package blank.

The details of end sealer construction and operation are well known and involve merely the intermittent horizontal inward and outward movement of a pair of sealing bars such as 73, 74, FIG. 2. The operation of the sealing bars is of course conducted in appropriately timed relationship with that of the side sealer, the vacuum belts, the product dispenser, etc. Heat sensitive sealing, pressure sensitive sealing and other forms of sealing may be employed.

Figure 8:
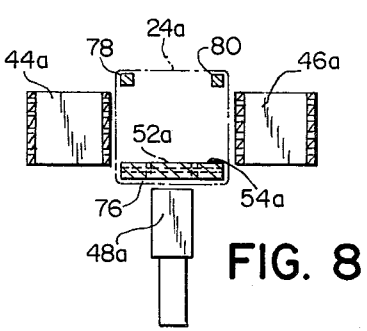
FIG. 8 is a horizontal cross sectional view taken generally as indicated at 8—8 in FIG. 6 and better illustrating the second embodiment of the improved back-up bar of the present invention.
Figure 6:
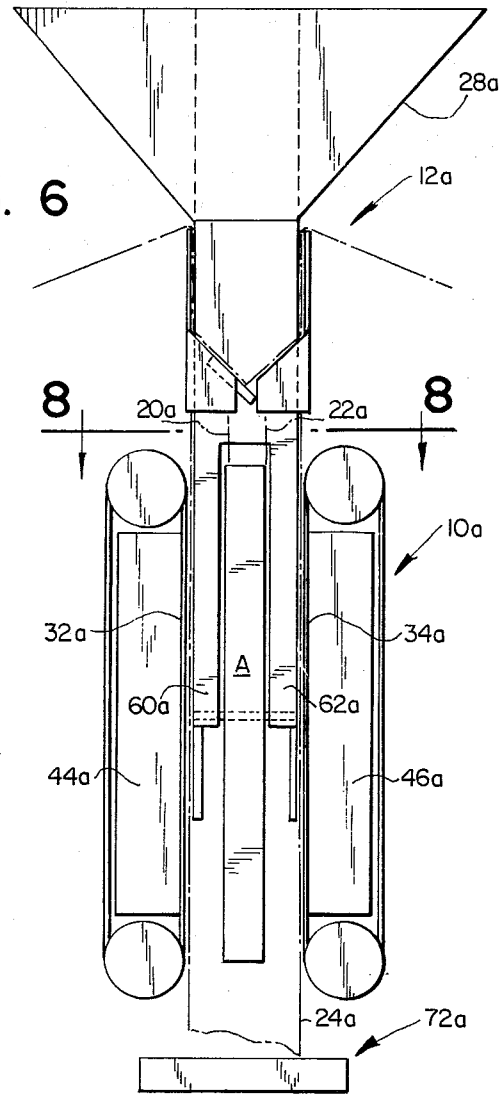
FIG. 6 is a somewhat schematic front elevational view similar to FIG. 1 but illustrates a square tube former in place of the round tube former of FIG. 1 together with a second embodiment of the improved back-up bar arrangement.

Referring now to FIG. 6–8, it will be observed that a packaging machine **10*a* includes a former 12*a* which is of the "square" type in contrast to the "round" former of FIGS. 1–3. A thin flat strip of packaging material 14*a* passes over guide roll 16*a* and 18*a* and is progressively formed to a generally square cross-sectional configuration in passage through the former 12*a* to provide a depending tube or tubular package blank 24*a*. A product dispenser is provided at 26*a* and vacuum belts 32*a* and 34*a* operate intermittently to advance or draw the tube downwardly through the former. Associated vacuum means 44*a* and 46*a* provide for the necessary suction gripping and terminal blow-off operation. An end sealing apparatus 72*a* comprises sealing bars 73*a* and 74*a* operable in the manner of the sealing bars 73 and 74** described above to seal the tubular blank at the bottom for product retention and at the top for a package closing operation.

As best illustrated in FIG. 7, a longitudinal seam sealing bar **48*a* extends vertically and is movable generally horizontally into and out of engagement with overlapped edges 20*a*, 22*a* of the tube or tubular blank 24*a*. The bar 48*a* operates in the manner of the bar 48 described above and cooperates with a back-up bar 52*a* which is similar to the bar 52, but which forms a second embodiment of the improved back-up arrangement of the present invention. The bar 52*a* is pivotally mounted by means of a cross pivot pin 64*a* at lower end portions of arms 60*a* and 62*a* of a support member 54*a*. The bar 52*a* thus swings freely into precise registry with the sealing bar 48*a*** and a highly efficient sealing operation results as described above.

The distinctive features of the back-up arrangement of FIGS. 6, 7 and 8 are best illustrated in FIG. 8 wherein the tube **24*a* is illustrated in its generally square cross-sectional configuration. More particularly, the support member 54*a* for the back-up bar 52*a* is provided with a front surface 76 which is substantially flat and which extends laterally to the opposite corners of one side of the tube. Thus, the support member 54*a* provides the dual function of back-up support and partial maintenance of the tube 24*a* in its desired square cross-sectional shape. Additional elements serving to maintain the tube 24*a* in its square configuration comprise a pair of tube spreaders 78 and 80. The spreaders 78 and 80 depend within the tube, are characterized by a minimal cross-sectional configuration, and are arranged respectively at the remaining two corners of the tube 24*a*.**

Figure 9:
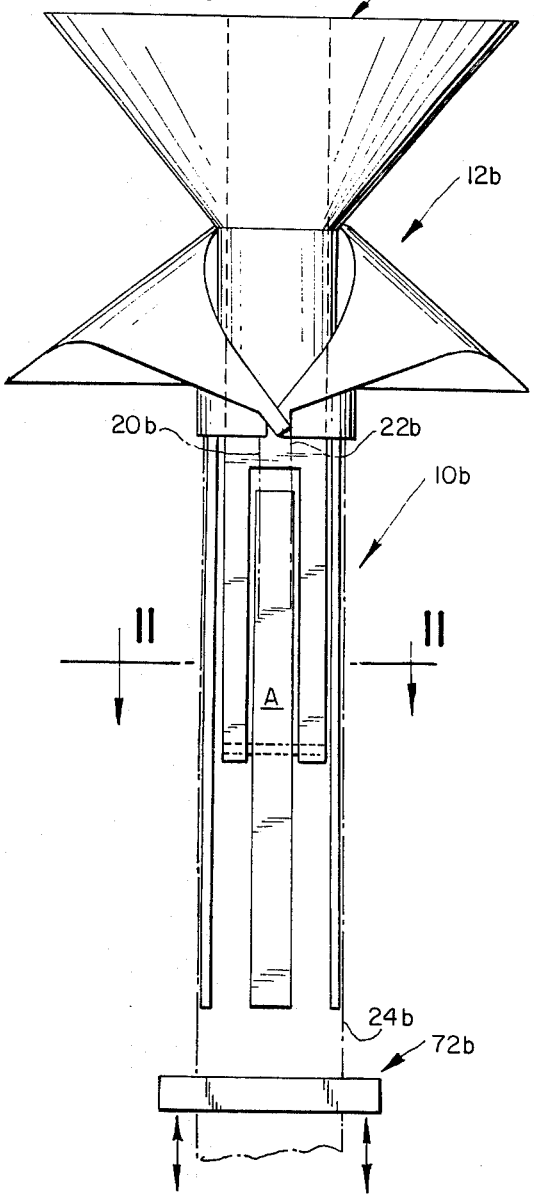
FIG. 9 is a somewhat schematic front elevational view of a portion of a form, fill and seal packaging machine similar to FIGS. 1 and 6 but illustrating a second form of tube advancing means.
Figure 10:
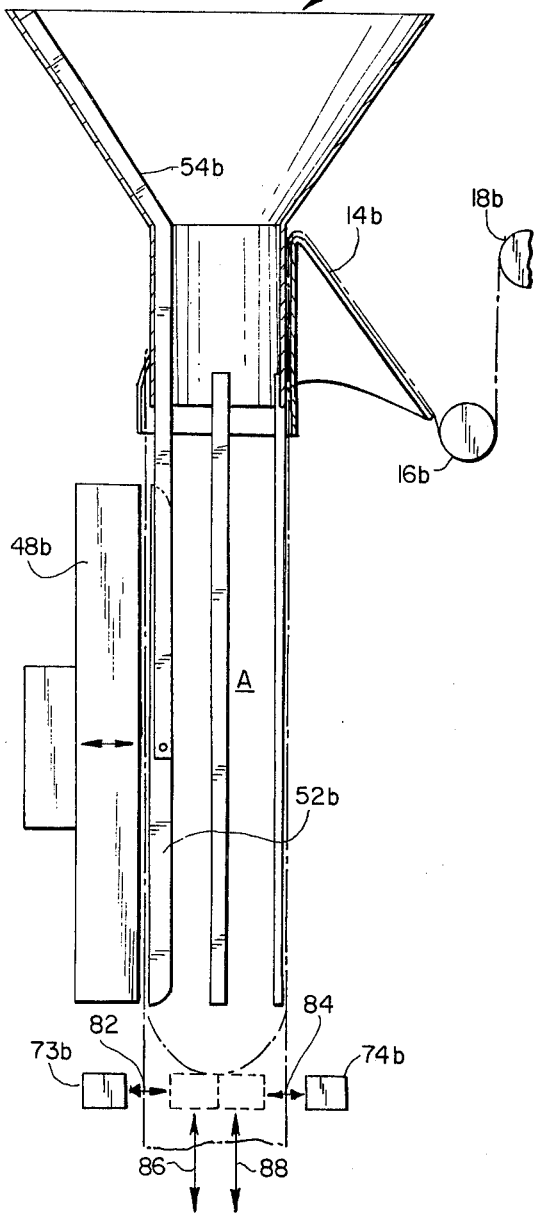
FIG. 10 is a somewhat schematic side elevational view of the apparatus of FIG. 9 including a longitudinal seam sealing bar and a fragmentary showing of a supply and guide system for the packaging material.
Figure 11:
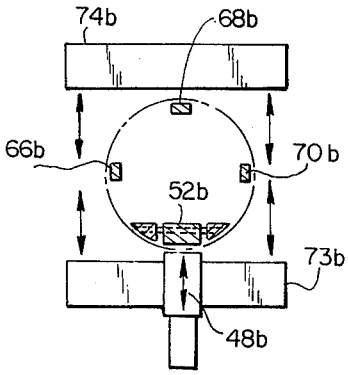
FIG. 11 is a somewhat schematic horizontal cross sectional view taken generally as indicated at 11—11 in FIG. 9.

The form, fill and seal package machine **10*b* partially illustrated in FIGS. 9–11 is substantially identical with the machine of FIGS. 1–3 except for the tube advancing means thereof. That is, the machine 10*b* has a round tube former 12*b* receiving a strip of material 14*b* which passes over guide roll 16*b* and 18*b* and a tube 24*b* is formed with overlapped longitudinal edge portions 20*b* and 22*b*. A product dispenser 26*b* is provided and a longitudinal seam sealer 48*b* cooperates with a back-up bar 52*b* supported by a member 54*b*. Three tube spreaders 66*b*, 68*b* and 70*b* cooperate with the back-up bar and its support member to maintain the tube 24*b* in its desired cylindrical configuration. All of the foregoing elements are or may be identical with like elements in FIGS. 1–3.**

In advancing the tube **24*b* or drawing the same downwardly through the former 12*b*, provision is made for the vertical reciprocation of end sealing bars 73*b* and 74*b*. That is, the bars 73*b* and 74*b* are movable generally horizontally as indicated by the arrows 82, 84 in their end sealing operation and they are also adapted for vertical reciprocation. When the bars 73*b*, 74*b* move inwardly to engage and seal the tube 24*b*, as illustrated in broken line form in FIG. 10, they are also moved downwardly as indicated by arrows 86, 88 whereby to advance or to draw the tube downwardly and to present a next succeeding tubular blank to the sealing station. Thereafter, the sealing bars 73*b*, 74*b*** may be withdrawn horizontally outwardly and returned to the full line position shown for subsequent engagement, sealing, and advancement of the next succeeding tubular blank.

While the tube advancing means of FIGS. 9–11 is somewhat less expeditious in its operation than the vacuum feed belts of the preceding embodiments, it has nevertheless found wide use in certain packaging operations. It is to be noted that the operation of the back-up bar **52*b*** is identical with that set forth above for the bars 52 and 52*a* and that a like improvement in sealing efficiency is achieved.

From the foregoing, it will be apparent that the improved back-up bar arrangement of the present invention results in highly efficient longitudinal seam sealing, the problem of sealing and back-up bar misalignment being wholly obviated. Moreover, the back-up bar, its support member, and the associated tube spreaders may be constructed with minimal cross-sectional configuration whereby to minimize obstruction to free product fall within the tubular blank. Overall machine speed may thus be increased to the economic advantage of the manufacturer and end user.

We claim:

1. In a vertical form, fill and seal packaging machine, having a source of packaging material in the form of an elongated thin flat strip comprising successive package blanks as integral contiguous sections thereof, a tube former adapter to receive said strip material and progressively to form the same to a depending and upwardly open tubular configuration in passage therethrough, opposite longitudinal edge portions of the material being progressively juxtaposed by said former in overlapping and in parallel vertically extending relationship, a product dispensing means associated with said former and operable intermittently for the gravity discharge of measured quantities of product to the tube interior space through its said upwardly open end, a longitudinal seam sealing station disposed beneath said former, intermittently operable tube advancing means to draw said tube downwardly whereby successively to present intergral blanks in tubular form at said seam sealing station, an elongated seam sealing bar extending vertically at said sealing station adjacent a tubular blank at the station and intermittently movable generally horizontally toward and away from and into and out of sealing engagement with the overlapped edge portions of the blank, the improvement comprising an elongated back-up bar for said sealing bar extending vertically relative to the tubular blank at the sealing station adjacent said overlapped edge portions and in approximate horizontal registry with said sealing bar, a support member for said back-up bar, bar-up bar mounting means associated with said support member adapted pivotally to support said bar approximately at its mid point whereby to provide for free angular bar adjustment, precise parallelism, and uniform pressure distribution between and throughout the length of said sealing and back-up bar during each longitudinal seam sealing operation, at least one narrow elongated tube spreader fixedly supported within said tubular blank, and end sealing apparatus subadjacent said longitudinal sealing station and operable intermittently to seal transversely end portions of said tubular blanks whereby to form product bearing packages.

2. In a vertical form, fill and seal packaging machine, having a source of packaging material in the form of an elongated thin flat strip comprising successive package blanks as integral contiguous sections thereof, a tube former adapted to receive said strip material and progressively to form the same to a depending and upwardly open tubular configuration in passage therethrough, opposite longitudinal edge portions of the material being progressively juxtaposed by said former in overlapping and in parallel vertically extending relationship, a product dispensing means associated with said former and operable intermittently for the gravity discharge of measured quantities of product to the tube interior space through its said upwardly open end, a longitudinal seam sealing station disposed beneath said former, intermittently operable tube advancing means disposed beneath said former to draw said tube downwardly whereby successively to present integral blanks in tubular form at said seam sealing station, an elongated seam sealing bar extending vertically at said sealing station externally adjacent a tubular blank at the station and intermittently movable generally horizontally toward and away from and into and out of sealing engagement with the overlapped edge portions of the blank, the improvement comprising an elongated back-up bar for said sealing bar extending vertically relative to the tubular blank at the sealing station internally adjacent said overlapped edge portions and in approximate horizontal registry with said sealing bar, an elongated support member for said back-up bar fixedly mounted at an upper end portion to extend vertically downwardly through said open upper end and within the tubular blank at the sealing station, back-up bar mounting means associated with said support member at a lower end portion and adapted pivotally to support said bar approximately at its mid-point whereby to provide for free angular bar adjustment, precise parallelism, and uniform pressure distribution and throughout the length of said sealing and back-up bar during each longitudinal seam sealing operation, at least one narrow elongated tube spreader fixedly supported at an upper end portion and depending through said open upper end and within said tubular blank at the sealing station, and end sealing apparatus subadjacent said longitudinal sealing station and operable intermittently to seal transversely end portions of said tubular blanks whereby to form product bearing packages.

3. The improvements in a vertical form, fill and seal packaging machine as set forth in claim 2 wherien said support member for said back-up bar has a bifurcated lower end portion defining a vertically elongated space exposed to the overlapped edge portions of a tubular package blank at the longitudinal sealing station, and wherein said back-up bar is pivotally supported by said mounting means at lower end portions of laterally spaced arms formed by said bifurcated end portion, the upper end portion of the bar being disposed for swinging movement in said exposed space therebetween.

4. The improvements in a vertical form, fill and seal packaging machine as set forth in claim 3 wherein said back-up bar mounting means takes the form of a horizontal pivot pin with opposite end portions held by said laterally spaced arms of said support member and with an intermediate portion entered in a suitable opening approximately at the mid-point of said back-up bar.

5. The improvements in a vertical form, fill and seal packaging machine as set forth in claim 2 wherein said tube advancing means comprises a pair of horizontally spaced vertically extending belts respectively externally engageable with opposite sides of a tubular package blank and operable in unison intermittently to draw the same downwardly as aforesaid.

6. The improvements in a vertical form, fill and seal packaging machine as set forth in claim 5 wherein said belts are at least partially perforate, and wherein vacuum generating means is associated therewith to effect suction gripping of the tube by the belts.

7. The improvements in a vertical form, fill and seal packaging machine as set forth in claim 2 wherein said tube advancing means comprises a vertically reciprocable end sealing apparatus operable intermittently to draw the tube downwardly when said apparatus engages the tube in an end sealing operation.

8. The improvements in a vertical form, fill and seal packaging machine as set forth in claim 2 wherein said tube former is adapted to provide a continuous tube of substantially cylindrical cross sectional configuration, and wherein said back-up bar support member is provided with an arcuate surface facing the tube and substantially conforming thereto.

9. The improvements in a vertical form, fill and seal packaging machine as set forth in claim 8 wherein three tube spreaders are provided and arranged to extend vertically within and in engagement with the tube approximately in equal circumaxially spaced relationship with respect to each other and with respect to said back-up bar and support member.

10. The improvements in a vertical form, fill and seal packaging machine as set forth in claim 2 wherein said tube former is adapted to provide a continuous tube of substantially square cross sectional configuration, and wherein said back-up bar support member is provided with flat surface facing the tube and extending laterally substantially to the opposite corners of one side thereof.

11. The improvements in a vertical form, fill and seal packaging machine as set forth in claim 10 wherein two tube spreaders are provided and arranged respectively to extend vertically at and to engage the two remaining tube corners.

* * * * *